United States Patent [19]

Hayashi

[11] Patent Number: 4,572,683

[45] Date of Patent: Feb. 25, 1986

[54] STRUCTURE FOR MOUNTING AN INK RIBBON CASSETTE ON A PRINTER CARRIAGE

[75] Inventor: Mikio Hayashi, Tokyo, Japan

[73] Assignee: Seikosha Co., Ltd., Tokyo, Japan

[21] Appl. No.: 565,186

[22] Filed: Dec. 23, 1983

[30] Foreign Application Priority Data

Dec. 27, 1982 [JP] Japan ..... 57-201631[U]

[51] Int. Cl.[4] ..... B41J 32/00

[52] U.S. Cl. ..... 400/208; 400/196.1; 400/224

[58] Field of Search ..... 400/194, 195, 196, 196.1, 400/207, 208, 208.1, 235.1, 236.2, 211, 212, 213, 213.1, 216.1, 216.2, 216.3, 216 A, 216.5, 224, 224.1, 240.4; 242/55, 19 A, 194, 197, 198, 199, 200; 403/167, 261, 263

[56] References Cited

U.S. PATENT DOCUMENTS

| | | | |
|---|---|---|---|
| 2,026,454 | 12/1935 | Benzing | 403/261 X |
| 2,415,180 | 2/1947 | John | 403/167 X |
| 2,533,763 | 12/1950 | Cacciotti | 403/263 X |
| 2,688,173 | 9/1954 | Van Peet | 403/263 X |
| 3,340,760 | 9/1967 | Wormser | 403/261 X |
| 3,384,393 | 5/1968 | Horton et al. | 403/261 X |
| 3,476,421 | 11/1969 | Torres | 403/263 X |
| 3,904,018 | 9/1975 | Denley | 400/196 |
| 4,232,976 | 11/1980 | Bernardis et al. | 400/195 X |
| 4,396,305 | 8/1983 | Shattuck et al. | 400/208 |
| 4,408,914 | 10/1983 | Ciesiel et al. | 400/208 |
| 4,425,046 | 1/1984 | Van Horne et al. | 400/212 X |
| 4,426,168 | 1/1984 | Jozuka et al. | 400/240.4 X |

FOREIGN PATENT DOCUMENTS

| | | | |
|---|---|---|---|
| 0048418 | 3/1982 | European Pat. Off. | 400/208 |
| 0021884 | 2/1981 | Japan | 400/207 |
| 0203586 | 12/1982 | Japan | 400/208 |
| 0042465 | 3/1983 | Japan | 400/240.4 |
| 0140260 | 8/1983 | Japan | 400/240.4 |
| 0179681 | 10/1983 | Japan | 400/224 |
| 0201687 | 11/1983 | Japan | 400/240.4 |

*Primary Examiner*—Ernest T. Wright, Jr.

*Attorney, Agent, or Firm*—Robert E. Burns; Emmanuel J. Lobato; Bruce L. Adams

[57] ABSTRACT

A combination of a printing head supporting carriage in a printer, and an ink ribbon cassette adapted for mounting on the carriage at an angle thereto and having a recess in which a printing head can be positioned. The cassette has at least one positioning pin at its bottom. A resilient lever is provided on the peripheral surface of the cassette which is substantially perpendicular to the bottom thereof. The lever has a lower end secured to the peripheral surface and a free upper end. The carriage has at its top a first inclined surface adapted to support the bottom of the cassette thereon, and having a hole for receiving the pin of the cassette therein. The carriage also has at its top a second inclined surface which is substantially perpendicular to the first inclined surface, and adapted to support the peripheral surface of the cassette thereon. The lever is engageable with the second inclined surface to hold the cassette on the carriage. The lever is elastically movable for disengagement from the second inclined surface. A resilient member is provided on the carriage for retaining the pin of the cassette in the hole.

16 Claims, 9 Drawing Figures

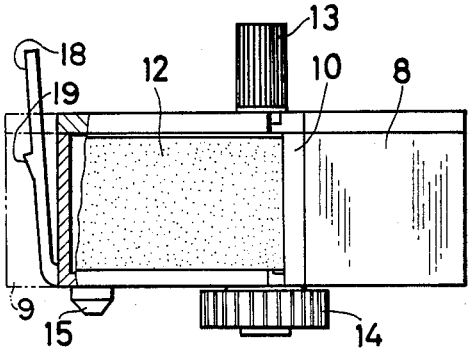
FIG. 3
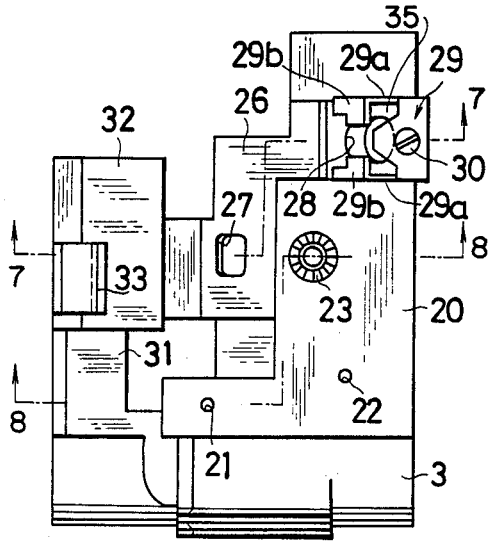
FIG. 6
FIG.4
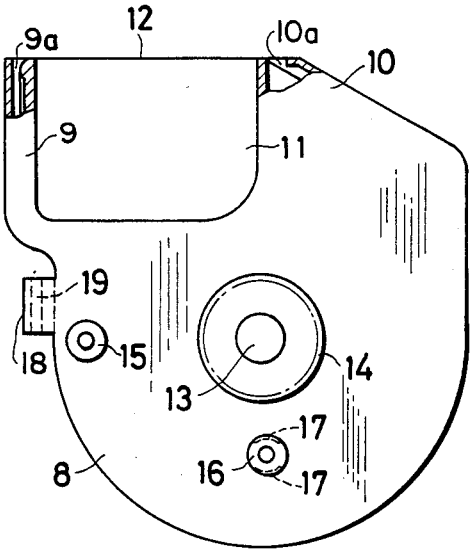
FIG. 7
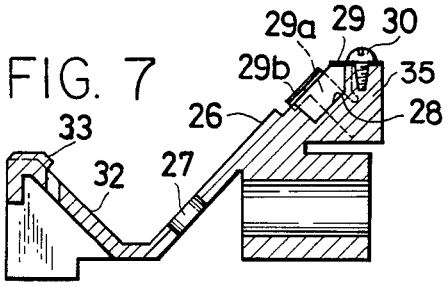
FIG.5
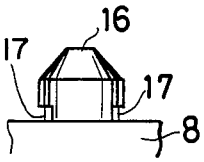
FIG.9
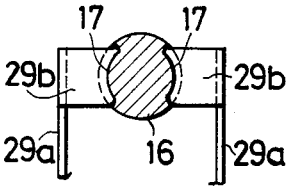
FIG.8
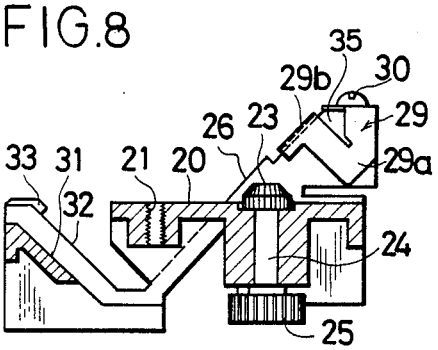

STRUCTURE FOR MOUNTING AN INK RIBBON CASSETTE ON A PRINTER CARRIAGE

BACKGROUND OF THE INVENTION

1. Field of the Invention

This invention relates to a structure for mounting an ink ribbon cassette on a printing head carriage in a printer.

2. Description of the Prior Art

An ink ribbon cassette for a printer usually takes a horizontal position when it is set on a carriage supporting a printing head. It is, however, sometimes necessary to set an ink ribbon cassette on the carriage at an angle thereto, or in inclined relationship thereto.

SUMMARY OF THE INVENTION

It is an object of this invention to provide a structure which facilitates the stabilized mounting of an ink ribbon cassette on a printing head carriage in a printer at an angle thereto, and the removal thereof, whenever necessary.

In a combination of a carriage supporting a printing head in a printer, and an ink ribbon cassette adapted for mounting on the carriage and having a recess in which the printing head can be positioned, the cassette has a ribbon feed gear and at least one positioning pin at its bottom, and an elastically deformable set lever on its peripheral surface. The set lever has a lower end secured to the bottom of the peripheral surface of the cassette, and a free upper end. The lever has a projection on its outer surface. The carriage is provided at its top with a drive gear having a vertical axis. The top of the carriage includes an inclined mounting surface on which the bottom of the cassette can rest, so that the ribbon feed gear may engage the drive gear at an angle thereto. The mounting surface has a hole in which the positioning pin can be received. The top of the carriage includes another inclined surface lying substantially at right angles to the mounting surface, and having a projection which is engageable with the projection on the set lever.

BRIEF DESCRIPTION OF THE DRAWING

FIG. 3 is a front elevational view, partly in section, of the cassette;

FIG. 4 is a bottom plan view, partly in section, of the cassette;

FIG. 5 is an enlarged side elevational view of a positioning pin on the cassette;

FIG. 6 is a top plan view of the carriage;

FIG. 7 is a sectional view taken along the line 7—7 of FIG. 6;

FIG. 8 is a sectional view taken along the line 8—8 of FIG. 6; and FIG. 9 is a fragmentary enlarged view showing the positioning pin held by a resilient retaining member on the carriage.

DETAILED DESCRIPTION OF THE INVENTION

Figure 1:
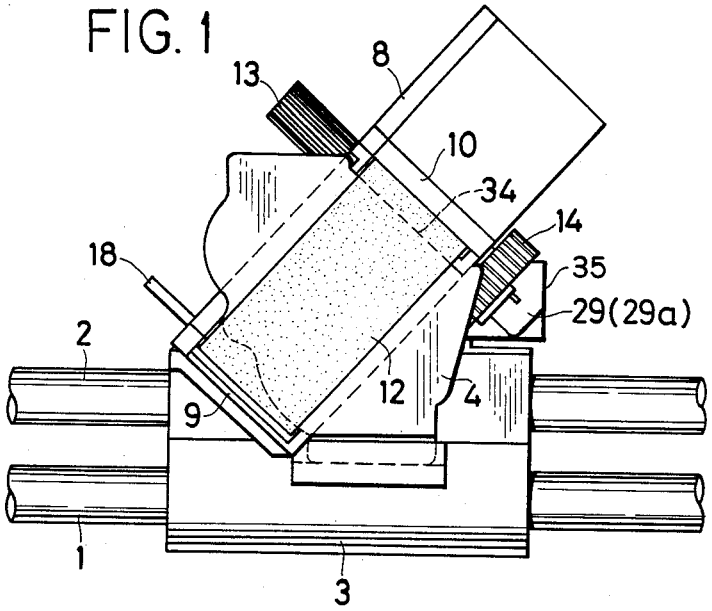
FIG. 1 is a front elevational view of an ink ribbon cassette set on a carriage in accordance with an embodiment of this invention.
Figure 2:
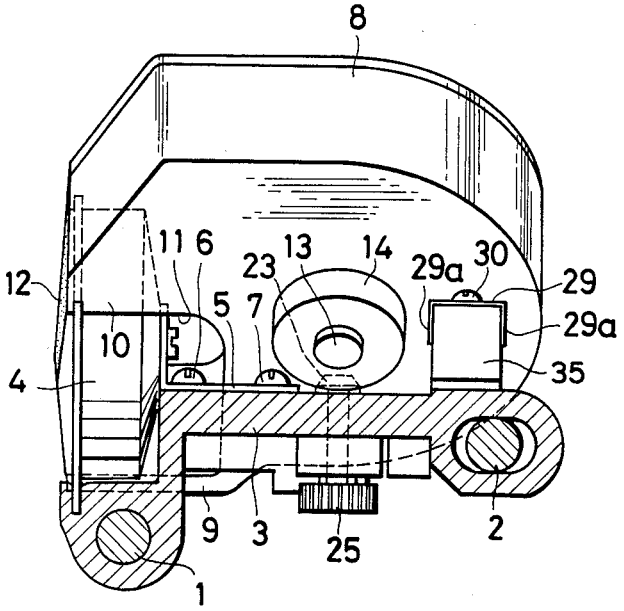
FIG. 2 is a side elevational view, partly in section, of the assembly shown in FIG. 1.

Referring to FIGS. 1 and 2 of the drawing, a carriage 3 in a printer is slidably supported on a pair of guide bars 1 and 2, and a printing head 4 is supported on the carriage 3. The printing head 4 is connected to the carriage 3 by an L-shaped bracket 5 which is secured to the upper surface of the carriage 3 by screws 6 and 7. An ink ribbon cassette 8 can be set on the carriage 3 at an angle thereto, or in an inclined position.

Referring to FIGS. 3 and 4, the ink ribbon cassette 8 has two arms 9 and 10 at its front end, and the arms 9 and 10 define therebetween a recess 11 in which the printing head 4 is received when the cassette 8 is set on the carriage 3. Each of the arms 9 and 10 has an opening 9*a* and 10*a* at its extremity. The cassette 8 contains an endless ink ribbon 12, and a portion of the ink ribbon 12 extends through the openings 9*a* and 10*a* of the extremities of the arms 9 and 10, as shown in FIG. 4. A shaft 13 extends through the cassette 8, and the shaft 13 has a pair of ends projecting from the top and bottom, respectively, of the cassette 8. A feed roller (not shown) is disposed in the cassette 8, and secured to the shaft 13. The feed roller is rotatable to move the ink ribbon 12 lengthwise along a path of travel which extends through a printing zone defined by the region between the arms 9 and 10. A ribbon feed gear 14 is secured to the lower end of the shaft 13. A pair of positioning pins 15 and 16 project downwardly from the bottom of the cassette 8. One of the pins 16 has a pair of diametrically opposite arcuate grooves 17, as shown in FIGS. 4 and 5. A set lever 18 is provided on the peripheral surface of the cassette 8 in the vicinity of the arm 9. The lever 18 has a lower end secured to the bottom of the peripheral surface of the cassette 8, and extends upwardly in a plane which is substantially vertical, but has a slight degree of inclination. The lever 18 has an inner surface facing the peripheral surface of the cassette 8, and an outer surface which is formed with a projection 19 intermediate the upper and lower ends of the lever 18.

Referring to FIGS. 6 to 8, the top of the carriage 3 includes a horizontal surface 20 having threaded holes 21 and 22 in which the screws 6 and 7 (FIG. 2) are respectively received. A drive gear 23 is provided on the horizontal surface 20, and is engageable with the ribbon feed gear 14 when the cassette 8 is set on the carriage 3, as shown in FIG. 2. The drive gear 23 has a vertical axis of rotation, and is supported on the upper end of a vertical shaft 24 extending through the carriage 3, as shown in FIG. 8. A gear 25 is secured to the lower end of the shaft 24. The gear 25 may be engaged with, for example, a fixed rack (not shown), to be driven for rotation when the carriage 3 is moved. The top of the carriage 3 also includes an inclined mounting surface 26 formed adjacent to the horizontal surface 20 to support the ribbon cassette 8 thereon. The mounting surface 26 is generally L-shaped in top plan as shown in FIG. 6, and has an upper edge located above the horizontal surface 20 and a lower edge located therebelow, as shown in FIG. 8. The mounting surface 26 has a pair of holes 27 and 28 in which the positioning pins 15 and 16 are respectively received when the cassette 8 is set on the mounting surface 26. One of the holes 28 is provided adjacent to the upper edge of the mounting surface 26. The carriage 3 has an upwardly directed extension 35 having an inclined surface which defines the upper half portion of the mounting surface 26 which projects above the horizontal surface 20.

A resilient retaining member 29 is secured by a screw 30 to the upward extension 35 of the carriage 3, and extends over the hole 28. The resilient retaining member 29 may be formed from a leaf spring. It has a horizontal base portion which is secured to the carriage 3 by the screw 30, and a pair of arm portions 29*a* depending from the opposite edges of the base portion along the opposite sides of the upward extension 35 of the carriage 3, as shown in FIGS. 7 and 8. Each arm portion 29*a* terminates at its free end in an inclined resilient retaining portion 29*b* lying parallel to the mounting surface 26 and over the hole 28. The retaining portion 29*b* has an arcuate edge as shown in FIG. 9. The arcuate edges of the two retaining portions 29*b* are spaced apart and face each other, and are engageable in the arcuate grooves 17 of the positioning pin 16, as shown in FIG. 9, when the pin 16 is forced into the hole 28 by elastically deforming the retaining portions 29*b* to initiate the mounting of the cassette 8 on the carriage 3.

The top of the carriage 3 also includes inclined surfaces 31 and 32 formed on the opposite side of the mounting surface 26 from the horizontal surface 20. The inclined surfaces 31 and 32 are substantially at right angles to the mounting surface 26. The inclined surface 26 and the inclined surfaces 31 and 32 define therebetween a generally V-shaped section or recess in which the ribbon cassette 8 is positioned with its peripheral side surface resting on the inclined surfaces 31 and 32. The inclined surface 32 has a projection 33 defining a downwardly facing shoulder, while the projection 19 on the set lever 18 has an upwarly facing shoulder as shown in FIG. 3. The shoulder on the lever 18 is engageable with the shoulder on the projection 33 when the cassette 8 is set on the carriage 3 as shown in FIGS. 1 and 2.

The ribbon cassette 8 can be removably mounted on the carriage 3 as will hereinafter be described. The cassette 8 is held in a horizontal position, and its positioning pin 16 is inserted into the hole 28 through the gap between the arcuate edges of the retaining portions 29*b* of the retaining member 29. The cassette 8 is then pushed down, and simultaneously rotated counterclockwise about the pin 16. If the cassette 8 is inclined to some extent, its arm 10 begins to contact a shoulder 34 on the printing head 4 (FIG. 1). The cassette 8 is further rotated counterclockwise, and pushed down against the mounting surface 26 until it rests on the surface 26, and its positioning pins 15 and 16 fit properly in the holes 27 and 28, respectively. When the cassette 8 is set as shown in FIGS. 1 and 2, the printing head 4 is located in the recess 11 defined by the arms 9 and 10 and the ink ribbon 12, and the ink ribbon 12 extends through the printing zone obliquely relative to the horizontal axis along which the carriage 3 translates. The retaining portions 29*b* of the retaining member 29 are engaged with the grooves 17 to retain the pin 16 in the hole 28. The inner wall of the arm 10 rests completely on the shoulder 34 of the printing head 4, as shown in FIG. 1. The projection 19 on the lever 18 is in latching engagement with the projection 33 on the carriage 3. The ribbon feed gear 14 meshes with the drive gear 23 at an angle thereto. The drive gear 23 is a bevel gear and the ribbon feed gear 14 is a spur gear. In this condition, when the drive gear 23 is rotated, the ribbon feed gear 14 is rotated to rotate the feed roller in the cassette 8 to move the ink ribbon 12 lengthwise along its path of travel. As the rotary axis of the feed gear 14 lies at an angle to the rotary axis of the drive gear 23, the rotation of the gears 14, 23 usually creates a force urging the gear 14 upwardly to thereby lift the cassette 8 away from the carriage 3. According to this invention, this force is counteracted by the latching engagement between the pin 16 and the retaining member 29, and between the lever projection 19 and the carriage projection 33. The lever 18 is normally biased in a direction away from the cassette 8 to achieve such latching engagement.

The cassette 8 can easily be removed from the carriage 3 if the set lever 18 is moved inwardly toward the cassette 8 to disengage its projection 19 from the carriage projection 33, and if the cassette 8 is rotated clockwise and lifted away from its engagement with the resilient retaining member 29.

What is claimed is:

1. In combination: a printing head supporting carriage mounted to undergo movement along a given axis in a printer, and an ink ribbon cassette mountable on said carriage at an angle thereto and having a recess in which a printing head can be positioned, the improvement which comprises:

said cassette having at least one positioning pin at its bottom;

a resilient lever provided on the peripheral surface of said cassette which is substantially perpendicular to said bottom thereof, said lever having a lower end secured to said peripheral surface and a free upper end;

said carriage having at its top a first inclined surface inclined relative to the given axis and shaped and dimensioned to support said bottom of said cassette thereon and having a hole for receiving said pin therein;

said carriage having at its top a second inclined surface which is substantially perpendicular to said first inclined surface and which is shaped and dimensioned to support said peripheral surface of said cassette thereon, said lever being releasably engageable with said second inclined surface to releasably hold said cassette on said carriage and being elastically movable for disengagement from said second inclined surface; and a retaining member attached to said carriage for retaining said pin in said hole.

2. The combination as set forth in claim 1, wherein said lever has an outer surface remote from said cassette and formed with a projection, and said second inclined surface has a projection which is engageable with said projection on said lever, said lever being normally biased in a direction away from said cassette.

3. The combination as set forth in claim 2, wherein said retaining member has a pair of resilient retaining portions which are spaced apart from each other to define therebetween a passage for said pin, and extend to some extent over said hole.

4. The combination as set forth in claim 3, wherein said pin has a pair of diametrically opposite arcuate grooves, and each of said retaining portions has an arcuate edge which is engageable with one of said grooves.

5. The combination as set forth in claim 4, wherein said cassette is provided at its bottom with a rotatable ribbon feed gear, and said carriage is provided at its top in an area other than said inclined surfaces with a rotatable drive gear having a vertical rotary axis and engageable with said ribbon feed gear at an angle thereto.

6. A carriage and ink ribbon cassette assembly for use in a printer comprising: a carriage translatable in use along a given axis and having a generally V-shaped section defined by first and second inclined surfaces which are inclined relative to the given axis; and an ink ribbon cassette containing an ink ribbon disposed to undergo lengthwise advancement along a given path of travel through a printing zone and being removably mounted in and supported by the generally V-shaped section of the carriage such that the given path of travel of the ink ribbon makes an oblique angle relative to the given axis.

7. An assembly according to claim 6; wherein the cassette has opposed top and bottom portions interconnected by a peripheral side portion, the cassette bottom portion being configured to overlie and be supported by the first inclined surface of the generally V-shaped section, and the cassette side portion being configured to overlie and be supported by the second inclined surface of the generally V-shaped section.

8. An assembly according to claim 7; wherein the cassette bottom portion has a projection projecting outwardly therefrom, and the first inclined surface has a hole dimensioned and positioned to receive therein the projection to thereby assist in positioning the cassette in a predetermined position on the carriage.

9. An assembly according to claim 8; including means for releasably retaining the cassette in the predetermined position on the carriage.

10. An assembly according to claim 7; wherein the cassette includes means including a rotatable ink ribbon feed gear rotatably mounted at the cassette bottom portion for effecting lengthwise advancement of the ink ribbon in response to rotation of the feed gear, and the carriage has gear means mounted adjacent the V-shaped section thereof and in meshing engagement with the feed gear to rotationally drive the feed gear.

11. An assembly according to claim 10; wherein the gear means comprises a rotatable drive gear rotatably mounted on the carriage in mesh with the feed gear.

12. An assembly according to claim 11; wherein the feed gear has an axis of rotation which is non-parallel to and makes an angle with the axis of rotation of the drive gear.

13. An assembly according to claim 12; wherein the drive gear comprises a bevel gear.

14. An assembly according to claim 13; wherein the feed gear comprises a spur gear.

15. An assembly according to claim 12; wherein the axis of rotation of the feed gear makes an oblique angle relative to the axis of rotation of the drive gear.

16. An assembly according to claim 7; wherein the first and second inclined surfaces have flat portions on which lie flush thereagainst flat portions of the cassette bottom and side portions.

* * * * *